US009318295B2

(12) United States Patent
Nguyen

(10) Patent No.: US 9,318,295 B2
(45) Date of Patent: Apr. 19, 2016

(54) CARBON NANOTUBE PATTERNING ON A METAL SUBSTRATE

(75) Inventor: Cattien V. Nguyen, San Jose, CA (US)

(73) Assignee: THE UNITED STATES OF AMERICA AS REPRESENTED BY THE ADMINISTRATOR OF THE NASA, Washington, DC (US)

( * ) Notice: Subject to any disclaimer, the term of this patent is extended or adjusted under 35 U.S.C. 154(b) by 2166 days.

(21) Appl. No.: 12/353,071

(22) Filed: Jan. 13, 2009

(65) Prior Publication Data

US 2009/0183770 A1 Jul. 23, 2009

Related U.S. Application Data

(60) Provisional application No. 61/022,291, filed on Jan. 18, 2008.

(51) Int. Cl.

| | |
|---|---|
| ***B05D 5/12*** | (2006.01) |
| ***H01J 1/304*** | (2006.01) |
| ***H01J 9/02*** | (2006.01) |

(52) U.S. Cl.

CPC ..... *H01J 1/304* (2013.01); *H01J 9/025* (2013.01); *H01J 2201/30469* (2013.01)

(58) Field of Classification Search

USPC ..... 427/58, 77, 122; 977/742

See application file for complete search history.

(56) References Cited

U.S. PATENT DOCUMENTS

| | | | | |
|---|---|---|---|---|
| 6,811,957 | B1 | 11/2004 | Mau et al. | |
| 6,866,801 | B1 * | 3/2005 | Mau et al. | 264/29.1 |
| 7,238,594 | B2 * | 7/2007 | Fonash et al. | 438/478 |
| 2005/0147746 | A1 | 7/2005 | Dublin et al. | |
| 2006/0233692 | A1 | 10/2006 | Scaringe et al. | |
| 2007/0242202 | A1 * | 10/2007 | Kawase | 349/139 |

FOREIGN PATENT DOCUMENTS

| | | |
|---|---|---|
| JP | 2003510236 | 3/2003 |
| KR | 1020050104650 | 3/2005 |

OTHER PUBLICATIONS

Bonard et al. "Carbon nanotube films as electron field emitters", Carbon, vol. 40, pp. 1715-1728 Dec. 12, 2001.*

Hu et al. "Field emission of carbon nanotubes grown on nciekl substrate", Science Direct, vol. 100, pp. 477-480, Jan. 25, 2006.*

(Continued)

*Primary Examiner* — Brian K Talbot

(74) *Attorney, Agent, or Firm* — Fabian Vancott; Jeffrey K. Riddle

(57) ABSTRACT

A CNT electron source, a method of manufacturing a CNT electron source, and a solar cell utilizing a CNT patterned sculptured substrate are disclosed. Embodiments utilize a metal substrate which enables CNTs to be grown directly from the substrate. An inhibitor may be applied to the metal substrate to inhibit growth of CNTs from the metal substrate. The inhibitor may be precisely applied to the metal substrate in any pattern, thereby enabling the positioning of the CNT groupings to be more precisely controlled. The surface roughness of the metal substrate may be varied to control the density of the CNTs within each CNT grouping. Further, an absorber layer and an acceptor layer may be applied to the CNT electron source to form a solar cell, where a voltage potential may be generated between the acceptor layer and the metal substrate in response to sunlight exposure.

14 Claims, 9 Drawing Sheets

(56) References Cited

OTHER PUBLICATIONS

"Direct Growth of Aligned Carbon Nanotubes on Bulk Metals", Talapatra, et al. Department of Materials Science and Engineering, Rensselaer Polytechnic Institute, vol. 1 Nov. 2006 pp. 112-116.
"Ultra-Low Threshold Field Electron Emission from Pillar Array of Aligned Carbon Nanotube Bundles", Katayama, et al., Department of Electronic Engineering, Osaka University, May 28, 2004 pp. L774-L776.
"Carbon Nanotube Films as Electron Field Emitters", Bonard,e t al., Apr. 3, 2001, 2002 Elsvier Science Ltd. pp. 1715-1728.
"Nanotechnology in the Development of Photovoltaic Cells", Manna, et al., Center for Energy Systems Research Tennessee Tech University IEEE 2007 pp. 379-386.
"Field Emission of Carbon Nanotubes Grown on Nickel Substrate", Hu, et al., College of Materials Science and Engineering, Nanjing University of Technology, Jan. 25, 2006 pp. 477-480.
International Search Report for PCT/US2009/000310; Filing Date: Jan. 16, 2009; Eloret Corporation et al; Submitted as a supporting document for JP 2003-510236 A, since English Abstract cannot be located.

* cited by examiner

CARBON NANOTUBE PATTERNING ON A METAL SUBSTRATE

RELATED APPLICATIONS

The present application claims the benefit of U.S. Provisional Patent Application No. 61/022,291, filed Jan. 18, 2008, entitled "SYSTEM AND METHOD FOR GROWING CARBON NANOTUBES ON METAL SUBSTRATES AND MODIFYING THE METAL SUBSTRATES TO CONTROL THE PROPERTIES OF THE CARBON NANOTUBES," naming Cattien V. Nguyen as the inventor. That application is incorporated herein by reference in its entirety and for all purposes.

GOVERNMENT INTERESTS

The inventions described herein were made by non-government employees, whose contributions were made in the performance of work under a NASA contract, and is subject to the provisions of Public Law 96-517 (35 U.S.C. §202). These inventions were made with Government support under contract NAS2-03144 awarded by NASA. The Government has certain rights in these inventions.

BACKGROUND OF THE INVENTION

Carbon nanotubes are often used in conventional electron sources given their robust physical, chemical and electrical properties. For example, carbon nanotubes (CNTs) generally have high aspect ratios providing a low turn-on field, thereby enabling CNTs to emit electrons well. The CNTs are generally grown on a metal catalyst disposed on a non-metal substrate such as silicon dioxide.

Despite the ability to produce conventional electron sources with CNTs, the functionality of conventional electron sources is limited given the limitations of applying the metal catalyst to the non-metal substrate. For example, it is difficult to apply the metal catalyst in a precise pattern to the non-metal substrate. As such, the spacing of CNT groupings grown on respective regions of metal substrate is often non-uniform and difficult to control, thereby reducing the effectiveness of conventional electron sources. Further, the density of the CNTs in each of the groupings is difficult to control.

Additionally, the process of applying the metal catalyst to the non-metal substrate, e.g., metal catalyst deposition, is relatively expensive. As such, the cost of producing conventional electron sources is increased due to the relatively high cost of applying the metal catalyst to the non-metal substrate.

SUMMARY OF THE INVENTION

Accordingly, a need exists for a carbon nanotube (CNT) electron source with improved effectiveness. More specifically, a need exists for a CNT electron source with improved patterning of CNT groupings. A need also exists for a CNT electron source with a CNT density which can be more precisely controlled during manufacturing. Further, a need exists for a CNT electron source which can be produced more cheaply than conventional electron sources. Embodiments of the present invention provide novel solutions to these needs and others as described below.

Embodiments are directed to a CNT electron source, a method of manufacturing a CNT electron source, and a solar cell utilizing a patterned CNT sculptured substrate. More specifically, embodiments utilize a metal substrate which enables CNTs to be grown directly from the substrate. An inhibitor may be applied to the metal substrate to inhibit growth of CNTs from the metal substrate. The inhibitor may be precisely applied to the metal substrate in any pattern (e.g., using photolithography, nanoimprinting with a patterned stamp, bubble jet printing, etc.), thereby enabling the positioning of the CNT groupings to be more precisely controlled. The surface roughness of the metal substrate may be varied (e.g., by polishing or roughening the metal substrate before growing the CNTs) to control the density of the CNTs within each CNT grouping. Further, an absorber layer and an acceptor layer may be applied to the CNT electron source to form a solar cell, where a voltage potential may be generated between the acceptor layer and the metal substrate in response to sunlight exposure.

In one embodiment, a method of manufacturing an electron source includes accessing a metal substrate. An inhibitor is applied to a first plurality of regions of the metal substrate, wherein the inhibitor is operable to inhibit growth of carbon nanotubes in the first plurality of regions of the metal substrate. The carbon nanotubes are grown on the metal substrate in a second plurality of regions separate from the first plurality of regions. Applying an inhibitor may be done by applying photoresist to the metal substrate and exposing a portion of the photoresist to ultraviolet light using a photolithography process, wherein the portion of the photoresist is disposed on the second plurality of regions. Unexposed portions of the photoresist disposed on the first plurality of regions of the metal substrate may be removed. The inhibitor may be applied to the metal substrate and the portion of the photoresist. Additionally, the portion of the photoresist may be removed leaving the inhibitor disposed on the first plurality of regions of the metal substrate.

Alternatively, the inhibitor may include a polymer, and wherein applying an inhibitor may be done by applying a polymer to the metal substrate. The polymer may be patterned using a patterned stamp, wherein the patterned stamp includes features corresponding to the first plurality of regions. The polymer may be cured while the patterned stamp is in place. And in another embodiment, applying the inhibitor may be done by applying the inhibitor using a bubble jet printing process In one embodiment, an electron source includes a metal substrate, an inhibitor disposed on a first plurality of regions of the metal substrate, and carbon nanotubes disposed on the metal substrate in a second plurality regions separate from the first plurality of regions. The metal substrate may include nickel chromium with an RMS surface roughness of less than approximately 5 nanometers. The carbon nanotubes may include a plurality of groupings of carbon nanotubes, and wherein each of the plurality of groupings of carbon nanotubes are physically separated from one another.

In yet another embodiment, a solar cell may include a metal substrate, an inhibitor disposed on a first plurality of regions of the metal substrate, and carbon nanotubes disposed on the metal substrate in a second plurality of regions separate from the first plurality of regions. An absorber layer is disposed on the inhibitor and the carbon nanotubes. Further, an acceptor layer is disposed on the absorber layer, the acceptor layer for generating a voltage potential with respect to the metal substrate in response to light exposure therewith.

BRIEF DESCRIPTION OF THE DRAWINGS

The present invention is illustrated by way of example, and not by way of limitation, in the figures of the accompanying drawings and in which like reference numerals refer to similar elements.

DETAILED DESCRIPTION OF THE INVENTION

Reference will now be made in detail to embodiments of the present invention, examples of which are illustrated in the accompanying drawings. While the present invention will be discussed in conjunction with the following embodiments, it will be understood that they are not intended to limit the present invention to these embodiments alone. On the contrary, the present invention is intended to cover alternatives, modifications, and equivalents which may be included with the spirit and scope of the present invention as defined by the appended claims. Furthermore, in the following detailed description of the present invention, numerous specific details are set forth in order to provide a thorough understanding of the present invention. However, embodiments of the present invention may be practiced without these specific details. In other instances, well-known methods, procedures, components, and circuits have not been described in detail so as not to unnecessarily obscure aspects of the present invention.

Embodiments of the present invention are generally directed to an electron source with a metal substrate which enables carbon nanotubes (CNTs) to be grown directly from the substrate. An inhibitor may be applied to the metal substrate to inhibit growth of CNTs from the metal substrate, thereby enabling the CNTs to be precisely positioned and/or patterned on the metal substrate. The inhibitor may be applied to the metal substrate using the following: photolithography (e.g., as discussed with respect to FIGS. 1, 2A and 2B); nanoimprinting with a patterned stamp (e.g., as discussed with respect to FIGS. 3 and 4); bubble jet printing (e.g., as discussed with respect to FIGS. 5 and 6); etc. The surface roughness of the metal substrate may be varied (e.g., by polishing or roughening the metal substrate before growing the CNTs) to control the density of the CNTs. Additionally, an absorber layer and an acceptor layer may be applied to the CNT electron source to form a solar cell (e.g., as discussed with respect to FIGS. 7 and 8), where a voltage potential may be generated between the acceptor layer and the metal substrate in response to sunlight exposure.

Figure 1:
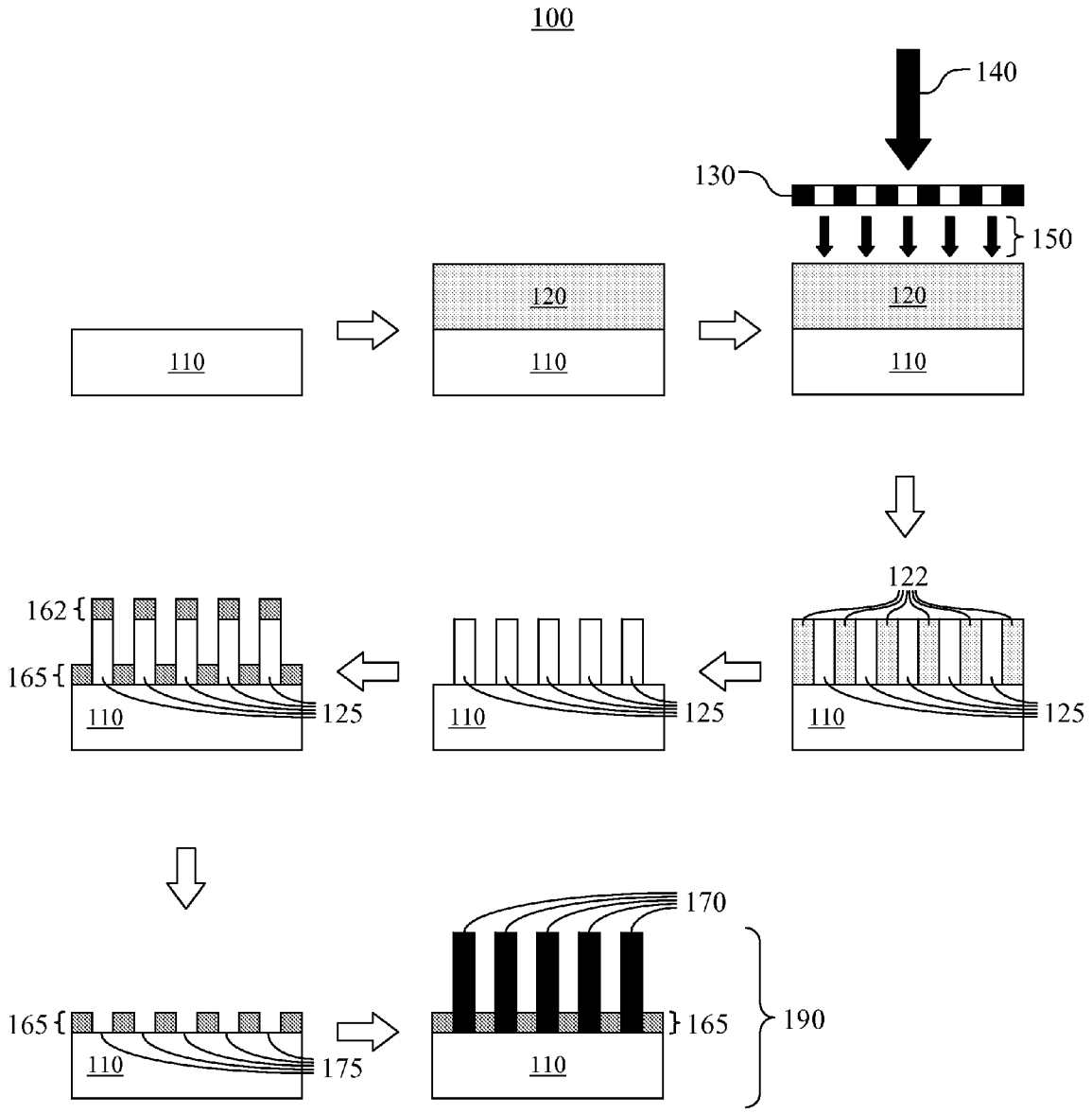
FIG. 1 shows diagrams of exemplary production stages of an electron source with a metal substrate using photolithography in accordance with one embodiment of the present invention.
Figure 2A:
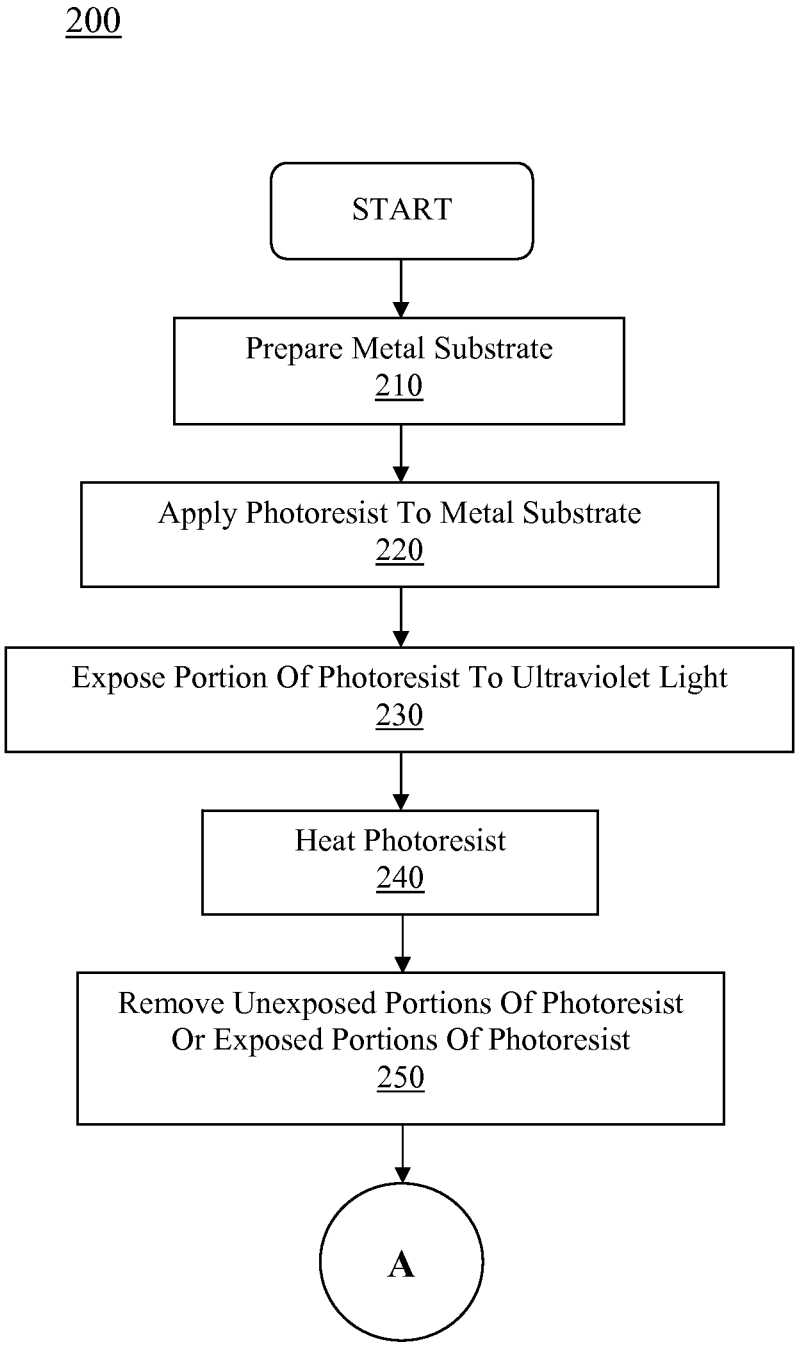
FIG. 2A shows a flowchart of a first portion of an exemplary process for manufacturing an electron source with a metal substrate using photolithography in accordance with one embodiment of the present invention.
Figure 2B:
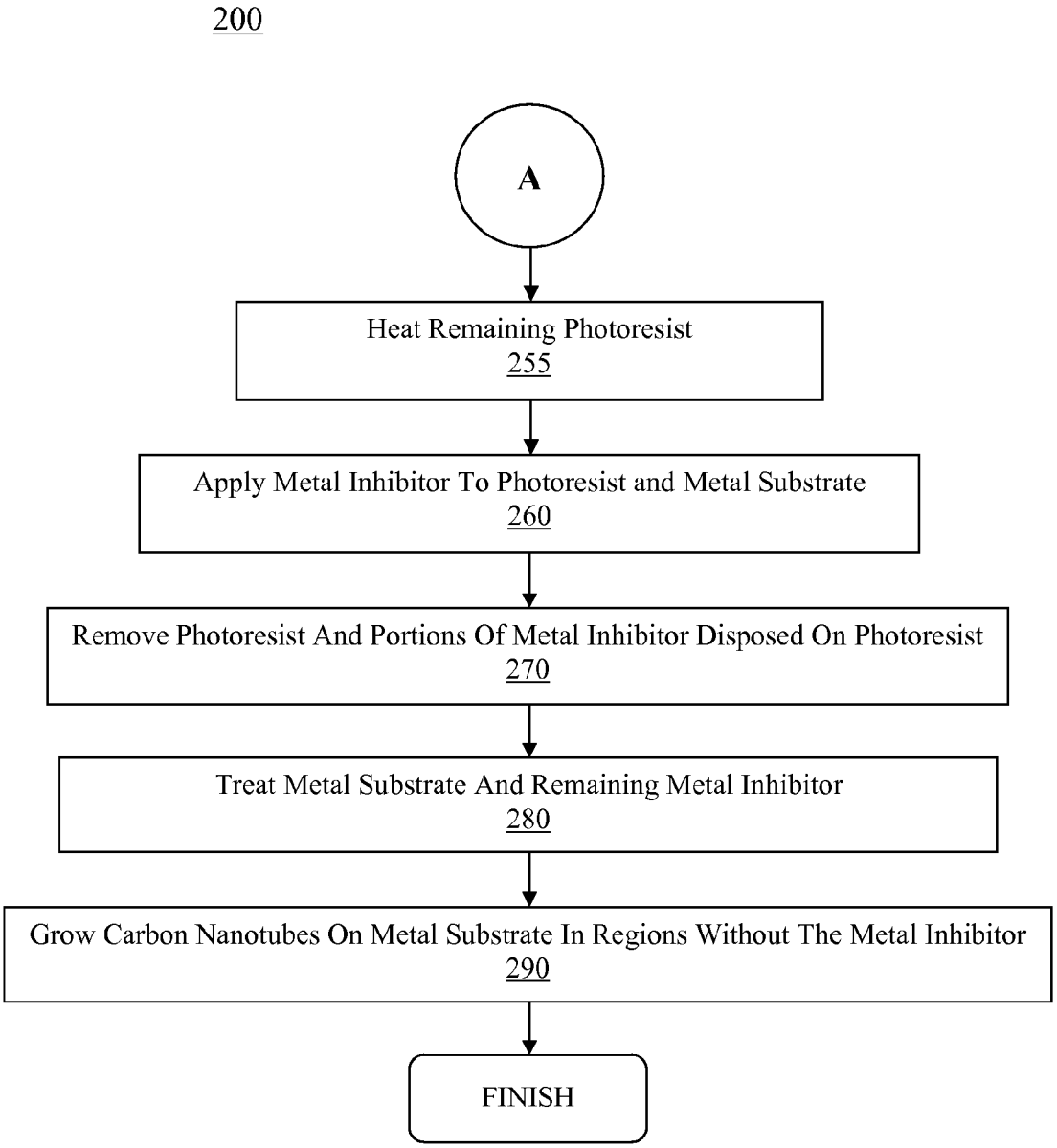
FIG. 2B shows a flowchart of a second portion of an exemplary process for manufacturing an electron source with a metal substrate using photolithography in accordance with one embodiment of the present invention.

FIG. 1 shows diagrams 100 of exemplary production stages of an electron source with a metal substrate using photolithography in accordance with one embodiment of the present invention. FIGS. 2A and 2B show a flowchart of exemplary process 200 for manufacturing an electron source with a metal substrate using photolithography in accordance with one embodiment of the present invention. Diagrams 100 of FIG. 1 will be described in conjunction with process 200 of FIGS. 2A and 2B.

As shown in FIG. 2A, step 210 involves preparing a metal substrate (e.g., 110 of FIG. 1). The metal substrate may include nickel chromium, a metal capable of growing carbon nanotubes, a metal alloy capable of growing carbon nanotubes, some combination thereof, etc. Additionally, preparation of the metal substrate may include changing the surface roughness of the substrate (e.g., by polishing the metal substrate, roughening the metal substrate, etc.), where the surface roughness may be used to adjust the density of carbon nanotubes (CNTs) grown from the metal substrate (e.g., as discussed with respect to step 290 below). In one embodiment, the metal substrate may be prepared with an RMS surface roughness of less than approximately 5 nanometers. Additionally, in one embodiment, the roughness of the substrate may be changed using chemical polishing, mechanical polishing, some combination thereof, etc.

In one embodiment, preparation of the metal substrate (e.g., 110) may include an HDMS treatment of the metal substrate to remove impurities (e.g., water, solvents, etc.). For example, a primer (e.g., MCC primer 80/20 produced by MicroChem Corporation of Newton, Mass.) may be applied (e.g., puddled) onto the metal substrate (e.g., 110) and spun-dry (e.g., for approximately 30 seconds at approximately 4,500 rpm). The metal substrate may then be heated or baked (e.g., at approximately 110 degrees Celsius for approximately two minutes).

Step 220 involves applying photoresist (e.g., 120) to the metal substrate (e.g., 110). The photoresist may include UV-60.6 in one embodiment. Additionally, the photoresist may be applied to the metal substrate using a spin-on process in one embodiment. Further, the photoresist may be heated or baked (e.g., at approximately 130 degrees Celsius for approximately one minute).

As shown in FIG. 2A, step 230 involves exposing a portion of the photoresist to ultraviolet light (e.g., 140). In one embodiment, the photoresist (e.g., 120) may be covered with a mask (e.g., 130) prior to exposing portion of the photoresist to ultraviolet light (e.g., 140). The mask (e.g., 130) may enable portions of the ultraviolet light (e.g. 150) to pass through the mask and expose corresponding portions of the photoresist (e.g., 120). For example, as shown in FIG. 1, the darkened squares of mask 130 may block light 140 (e.g., leaving portions 122 of photoresist 120 unexposed) while the light squares of mask 130 may enable light 140 to pass through mask 130 (e.g., as represented by light 150) and expose portions 125 of photoresist 120. In this manner, the mask (e.g., 130) may be used to pattern the photoresist (e.g., 120) and ultimately pattern the CNTs grown from the metal substrate (e.g., in step 290 of process 200).

Mask 130 may include a transmission electron microscopy (TEM) grid. Alternatively, mask 130 may include a stencil mask, photolithography mask, or the like.

Step 240 involves heating or baking the photoresist (e.g., 110). In one embodiment, the post-exposure bake may include heating the photoresist (e.g., 110) at 140 degree Celsius for approximately 90 seconds.

As shown in FIG. 2A, step 250 involves removing unexposed portions (e.g., 122) of the photoresist (e.g., 120) or exposed portions (e.g., 125) of the photoresist (e.g., 120). In one embodiment, acetone may be applied to the photoresist to remove the portions (e.g., 122, 125, etc.) of the photoresist.

As shown in FIG. 2B, step 255 involves heating the remaining photoresist (e.g., exposed portions 125 of photoresist 120, unexposed portions 122 of photoresist 120 where exposed portions 125 are removed in step 250, etc.). In one embodiment, the remaining photoresist may be heated or baked at approximately 140 degrees Celsius for approximately three minutes.

Step 260 involves applying an inhibitor (e.g., 162 and 165) to the remaining photoresist (e.g., exposed portions 125 of photoresist 120, unexposed portions 122 of photoresist 120 where exposed portions 125 are removed in step 250, etc.) and the metal substrate (e.g., 110). The inhibitor may be used to inhibit the growth of CNTs in the regions of the metal substrate on which the inhibitor is disposed. Additionally, the inhibitor (e.g., 162 and 165) may include any material that inhibits the growth of CNTs. For example, the inhibitor (e.g., 162 and 165) may include a non-metal, a polymer, and a metal (e.g., Mo, Al, Cr, etc.). And in one embodiment, the inhibitor (e.g., 162 and 165) may include IBS molybdenum.

As shown in FIG. 2B, step 270 involves removing the remaining photoresist (e.g., exposed portions 125 of photoresist 120, unexposed portions 122 of photoresist 120 where exposed portions 125 are removed in step 250, etc.) and the portions of the metal inhibitor disposed on the remaining photoresist (e.g., portions 162 of the metal inhibitor disposed on photoresist portions 125, portions of the metal inhibitor disposed on unexposed portions 122 of photoresist 120 where exposed portions 125 are removed in step 250, etc.). In this manner, only portions of the metal inhibitor (e.g., 165) disposed on regions of the metal substrate (e.g., 110) may remain, thereby patterning the remaining inhibitor (e.g., 165) and creating regions on the surface of the metal substrate without any metal inhibitor (e.g., regions 175). In one embodiment, the remaining photoresist (e.g., exposed portions 125 of photoresist 120, unexposed portions 122 of photoresist 120 where exposed portions 125 are removed in step 250, etc.) may be removed using at least two consecutive baths with a developer (e.g., Microposit 1165), where each bath lasts for approximately 5 minutes at approximately 80 degrees Celsius.

Step 280 involves treating the metal substrate (e.g., 110) and the remaining metal inhibitor (e.g., 165). In one embodiment, the metal substrate (e.g., 110) and the remaining metal inhibitor (e.g., 165) may be washed with de-ionized water and cleaned with methanol.

As shown in FIG. 2B, step 290 involves growing CNTs (e.g., 170) in regions of the metal substrate without metal inhibitor disposed thereon (e.g., in regions 175). The CNTs (e.g., 170) may be multi-walled carbon nanotubes (MWNTs) in one embodiment. Each pillar or grouping of CNTs (e.g., 170) grown from the metal substrate (e.g., 110) may be physically spaced from one another. Additionally, the pillars or groupings of CNTs may be patterned in accordance with the mask (e.g., 130) used to expose portions of the photoresist (e.g., as discussed with respect to step 230). Further, the density of each grouping of CNTs (e.g., 170) may be related to the surface roughness of the metal substrate (e.g., in regions 175 of metal substrate 110) in one embodiment.

Accordingly, exemplary process 200 may be used to produce an electron source (e.g., 190) with a metal substrate (e.g., 110). The electron source (e.g., 190) may be produced without metal catalyst deposition in one embodiment. Additionally, the CNTs may be grown (e.g., in step 290) directly from the substrate (e.g., instead of from a metal catalyst deposited on another substrate layer). Further, it should be appreciated that the electron source (e.g., 190) produced in accordance with process 200 may be used in any application where lighting suitable to its characteristics is required such as for backlighting of a liquid crystal display (LCD) and/or other lighting applications (e.g., as a light source or light bulb). The electron source (e.g., 190) produced in accordance with process 200 may also be used in other applications, for instance, as part of a solar cell (e.g., as discussed with respect to FIGS. 7 and 8 herein), as a heatsink (e.g., using the metal substrate to dissipate heat), etc.

Although FIG. 1 shows electron source 190 with components (e.g., metal substrate 110, inhibitor 165, and CNTs 170) of a specific number, shape, size, etc., it should be appreciated that components of a different number, shape, size, etc. may be used in other embodiments. For example, metal substrate 110 maybe shaped like a roof tile, roof shingle or another surface, thereby enabling metal substrate 110 to be applied to a roofing material (e.g., for a home) or manufactured as a part of a roof tile for use in solar panel applications. And in other embodiments, metal substrate 110 may be alternatively shaped and/or sized.

Figure 3:
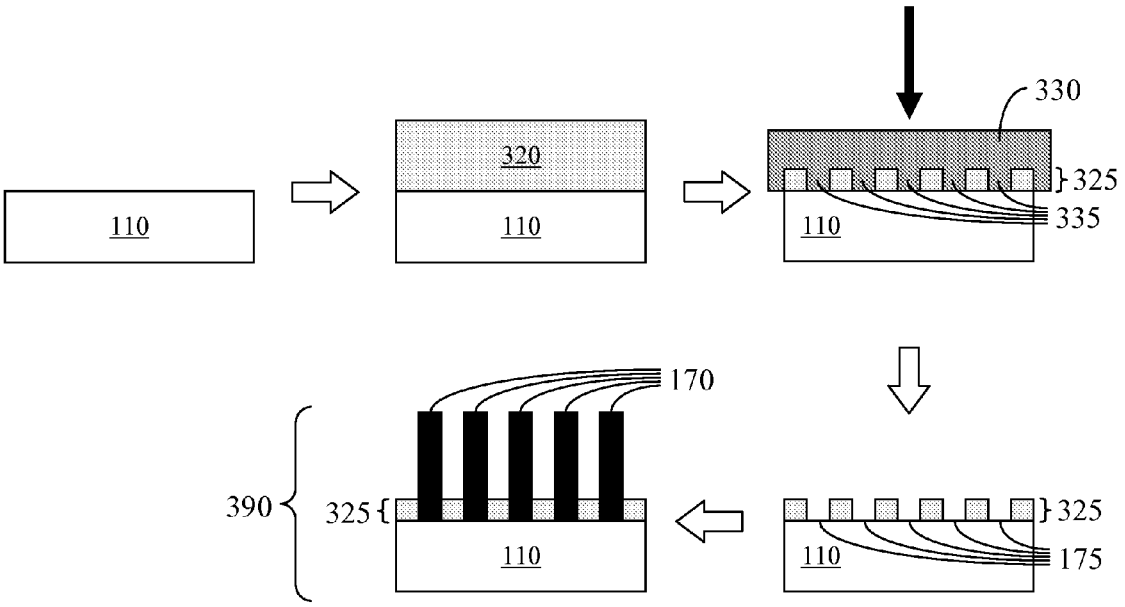
FIG. 3 shows diagrams of exemplary production stages of an electron source with a metal substrate using nanoimprinting with a patterned stamp in accordance with one embodiment of the present invention.
Figure 4:
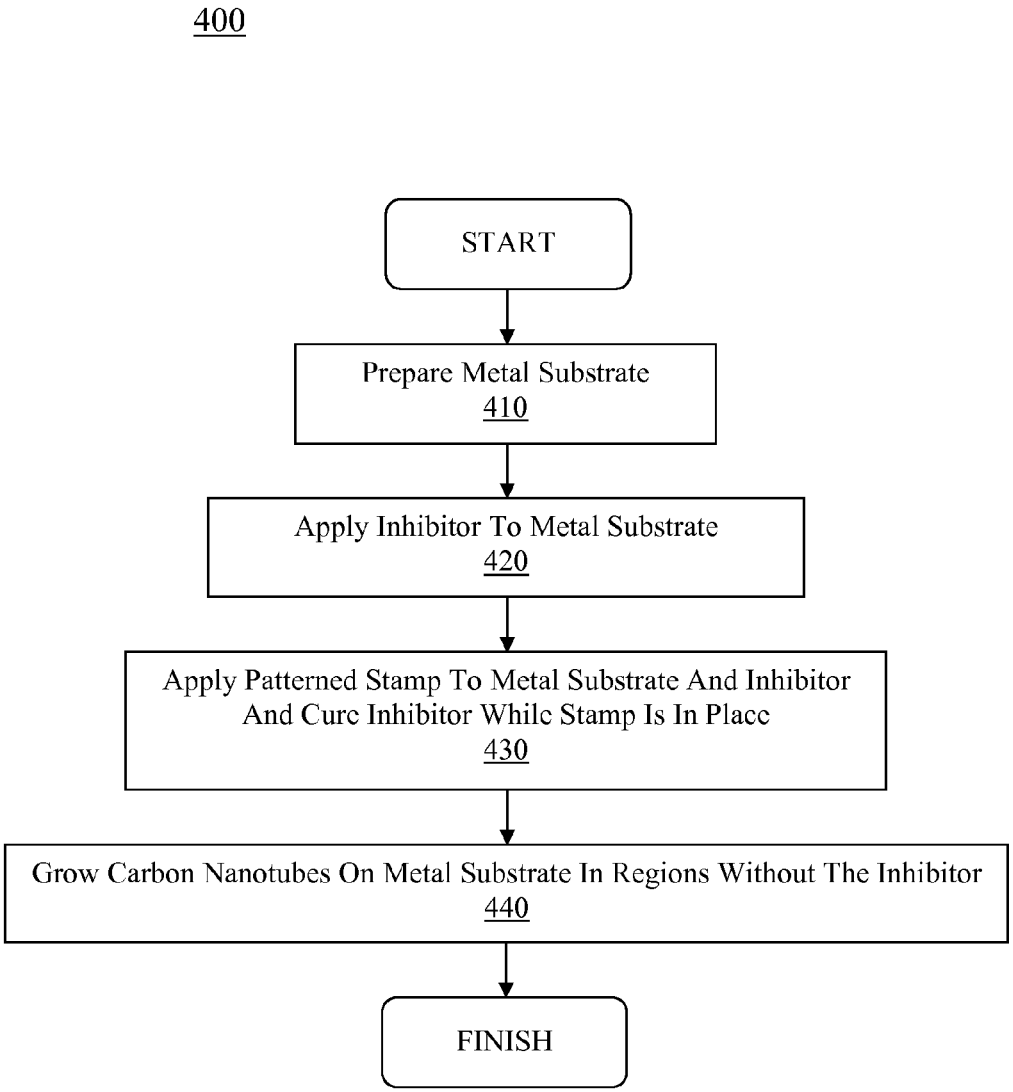
FIG. 4 shows a flowchart of an exemplary process for manufacturing an electron source with a metal substrate using nanoimprinting with a patterned stamp in accordance with one embodiment of the present invention.

FIG. 3 shows diagrams 300 of exemplary production stages of an electron source with a metal substrate using nanoimprinting with a patterned stamp in accordance with one embodiment of the present invention. FIG. 4 shows a flowchart of exemplary process 400 for manufacturing an electron source with a metal substrate using nanoimprinting with a patterned stamp in accordance with one embodiment of the present invention. Diagrams 300 of FIG. 3 will be described in conjunction with process 400 of FIG. 4.

As shown in FIG. 4, step 410 involves preparing the metal substrate (e.g., 110). Step 410 may be performed analogously to step 210 of FIG. 2A in one embodiment.

Step 420 involves applying inhibitor (e.g., 320) to the metal substrate (e.g., 110). The inhibitor (e.g., 320) may include a thermoset polymer in one embodiment. The thermoset polymer may be curable using heat, light, chemical reactions, drying, etc.

As shown in FIG. 4, step 430 involves applying a patterned stamp (e.g., 330) to the metal substrate (e.g., 110) and inhibitor (e.g., 320). The patterned stamp (e.g., 330) may have a plurality of features (e.g., 335) arranged to form a pattern in one embodiment. The features may pattern the inhibitor (e.g., by displacing and/or forming the inhibitor) when the patterned stamp (e.g., 330) is brought into contact with the inhibitor (e.g., 320) and/or metal substrate (e.g., 110), thereby forming inhibitor portions 325 which may be arranged in a pattern corresponding to the pattern of the features (e.g., 335) of the patterned stamp (e.g., 330).

Step 430 also involves curing the inhibitor while the stamp is in place (e.g., pressed against inhibitor 320 and/or metal substrate 110). The inhibitor may be cured using heat, light, a chemical reaction, drying, etc. Accordingly, the inhibitor features (e.g., 325) may be maintained or locked in place after the inhibitor is cured in step 430.

As shown in FIG. 4, step 440 involves growing CNTs (e.g., 170) in regions of the metal substrate without inhibitor disposed thereon (e.g., in regions 175). Step 440 may be performed analogously to step 290 of FIG. 2B in one embodiment.

Accordingly, exemplary process 400 may be used to produce an electron source (e.g., 390) with a metal substrate (e.g., 110). The electron source (e.g., 390) may be produced without metal catalyst deposition in one embodiment. Additionally, the CNTs may be grown (e.g., in step 440) directly from the substrate (e.g., instead of from a metal catalyst deposited on another substrate layer). Further, it should be appreciated that the electron source (e.g., 390) produced in accordance with process 400 may be used in any application where lighting suitable to its characteristics is required such as for backlighting of a liquid crystal display (LCD) and/or other lighting applications (e.g., as a light source or light bulb). The electron source (e.g., 390) produced in accordance with process 400 may also be used in other applications, for instance, as part of a solar cell (e.g., as discussed with respect to FIGS. 7 and 8 herein), as a heatsink (e.g., using the metal substrate to dissipate heat), etc.

Although FIG. 3 shows electron source 390 with components (e.g., metal substrate 110, inhibitor 325, and CNTs 170) of a specific number, shape, size, etc., it should be appreciated that components of a different number, shape, size, etc. may be used in other embodiments. For example, metal substrate 110 maybe shaped like a roof tile, roof shingle or another surface, thereby enabling metal substrate 110 to be applied to a roofing material (e.g., for a home) or manufactured as a part of a roof tile for use in solar panel applications. And in other embodiments, metal substrate 110 may be alternatively shaped and/or sized.

Figure 5:
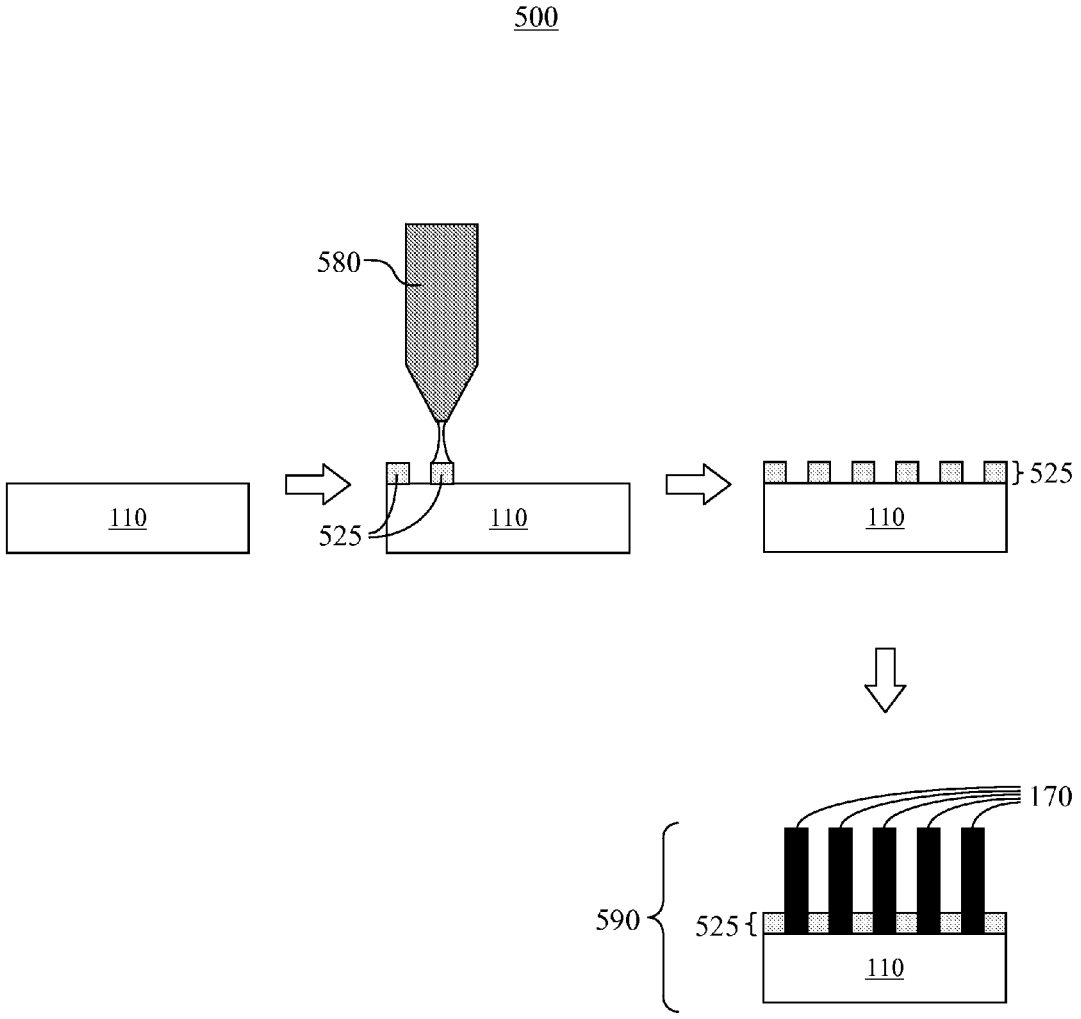
FIG. 5 shows diagrams of exemplary production stages of an electron source with a metal-substrate using bubble jet printing in accordance with one embodiment of the present invention.
Figure 6:
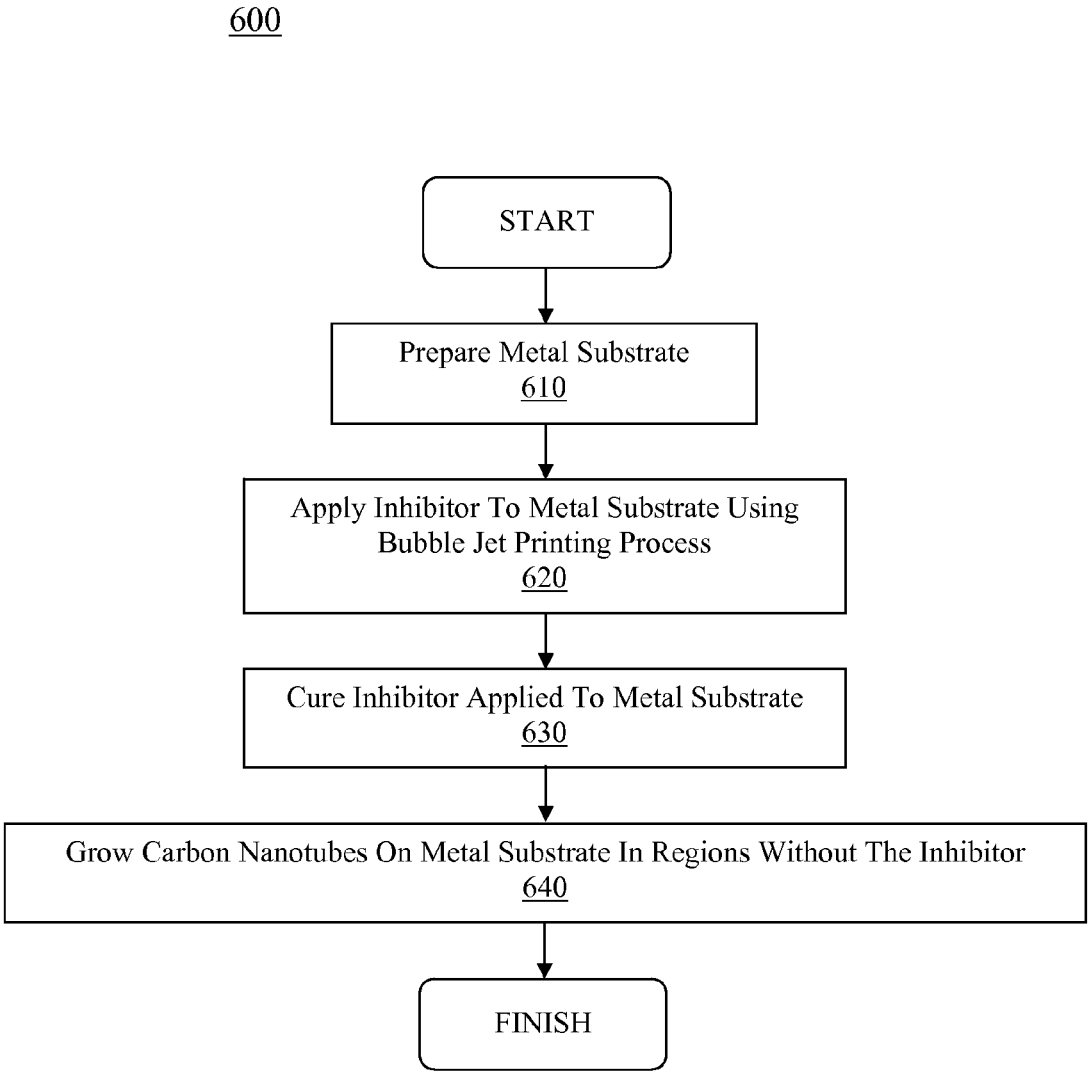
FIG. 6 shows a flowchart of an exemplary process for manufacturing an electron source with a metal substrate using bubble jet printing in accordance with one embodiment of the present invention.

FIG. 5 shows diagrams 500 of exemplary production stages of an electron source with a metal substrate using bubble jet printing in accordance with one embodiment of the present invention. FIG. 6 shows a flowchart of exemplary process 600 for manufacturing an electron source with a metal substrate using bubble jet printing in accordance with one embodiment of the present invention. Diagrams 500 of FIG. 5 will be described in conjunction with process 600 of FIG. 6.

As shown in FIG. 6, step 610 involves preparing the metal substrate (e.g., 110). Step 610 may be performed analogously to step 210 of FIG. 2A in one embodiment.

Step 620 involves applying inhibitor (e.g., 525) to the metal substrate (e.g., 110) using bubble jet printing. The inhibitor (e.g., 525) may include a polymer in one embodiment. Additionally, the inhibitor (e.g., 525) may be applied to the metal substrate (e.g., 110) by a nozzle (e.g., 580) as shown in FIG. 5, where the nozzle (e.g., 580) may deposit the inhibitor (e.g., 525) in locations specified by a computer system (e.g., similar to an ink jet printer). The inhibitor (e.g., 525) may be applied in step 620 in a pattern in one embodiment.

As shown in FIG. 6, step 630 involves curing the inhibitor (e.g., 525) applied to the metal substrate (e.g., 110). In one embodiment, the inhibitor (e.g., 525) may be cured by the application of heat and/or light, by a chemical reaction, by drying, etc.

Step 640 involves growing CNTs (e.g., 170) in regions of the metal substrate without inhibitor disposed thereon (e.g., in regions 175). Step 640 may be performed analogously to step 290 of FIG. 2B in one embodiment.

Accordingly, exemplary process 600 may be used to produce an electron source (e.g., 590) with a metal substrate (e.g., 110). The electron source (e.g., 590) may be produced without metal catalyst deposition in one embodiment. Additionally, the CNTs may be grown (e.g., in step 640) directly from the substrate (e.g., instead of from a metal catalyst deposited on another substrate layer). Further, it should be appreciated that the electron source (e.g., 590) produced in accordance with process 600 may be used in any application where lighting suitable to its characteristics is required such as for backlighting of a liquid crystal display (LCD) and/or other lighting applications (e.g., as a light source or light bulb). The electron source (e.g., 590) produced in accordance with process 600 may also be used in other applications, for instance, as part of a solar cell (e.g., as discussed with respect to FIGS. 7 and 8 herein), as a heatsink (e.g., using the metal substrate to dissipate heat), etc.

Although FIG. 5 shows electron source 590 with components (e.g., metal substrate 110, inhibitor 525, and CNTs 170) of a specific number, shape, size, etc., it should be appreciated that components of a different number, shape, size, etc. may be used in other embodiments. For example, metal substrate 110 maybe shaped like a roof tile, roof shingle or another surface, thereby enabling metal substrate 110 to be applied to a roofing material (e.g., for a home) or manufactured as a part of a roof tile for use in solar panel applications. And in other embodiments, metal substrate 110 may be alternatively shaped and/or sized.

Figure 7:
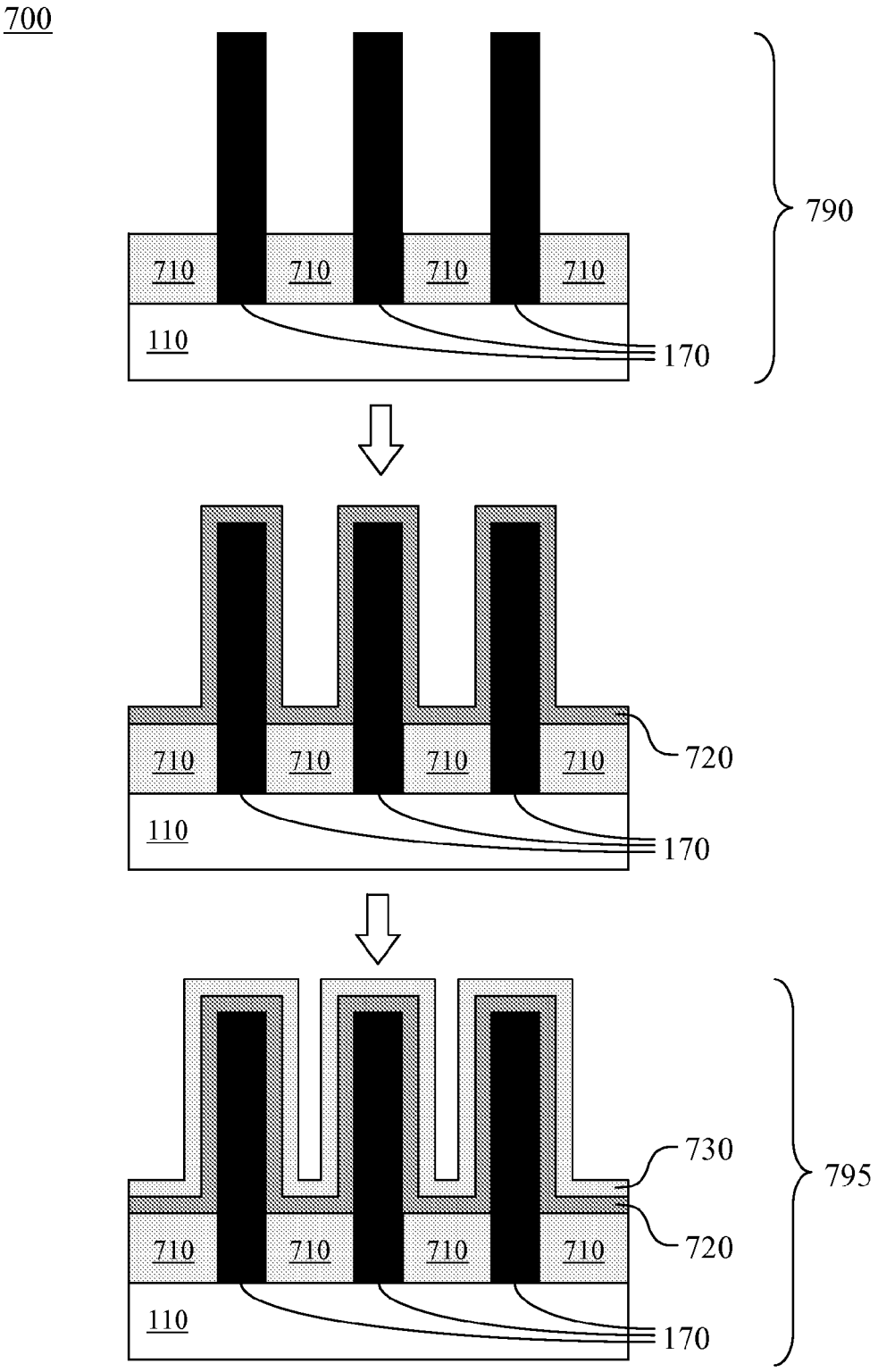
FIG. 7 shows diagrams of exemplary production stages of a solar cell or panel using a patterned CNT sculptured substrate in accordance with one embodiment of the present invention.
Figure 8:
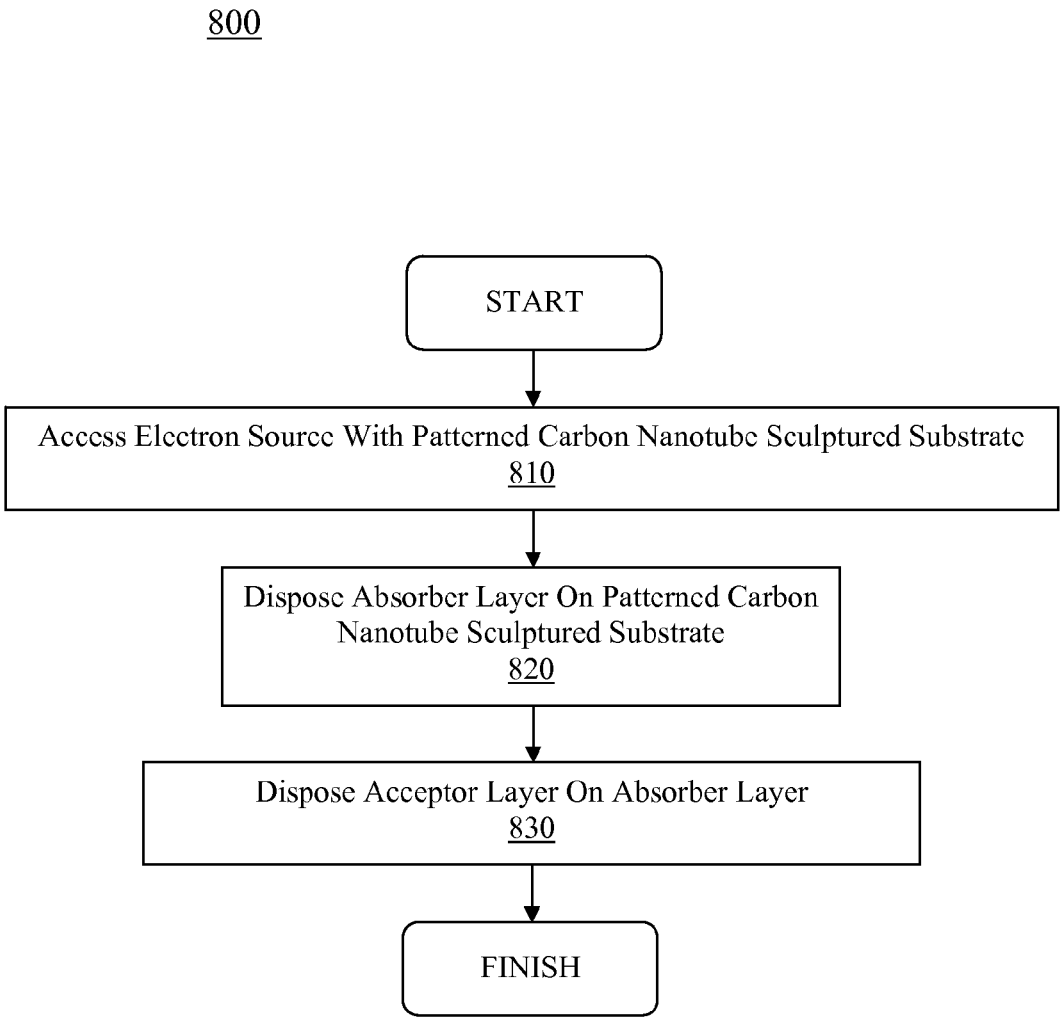
FIG. 8 shows a flowchart of an exemplary process for manufacturing a solar cell or panel using a patterned CNT sculptured substrate in accordance with one embodiment of the present invention.

FIG. 7 shows diagrams 700 of exemplary production stages of a solar cell or panel using a patterned CNT sculptured substrate in accordance with one embodiment of the present invention. FIG. 8 shows a flowchart of exemplary process 800 for manufacturing a solar cell or panel using a patterned CNT sculptured substrate in accordance with one embodiment of the present invention. Diagrams 700 of FIG. 7 will be described in conjunction with process 800 of FIG. 8.

As shown in FIG. 8, step 810 involves accessing a patterned CNT sculptured substrate. For example, as shown in FIG. 7, patterned CNT sculptured substrate 790 may be accessed, where sculptured substrate 790 may be produced in accordance with process 200 (e.g., and therefore may be analogous to electron source 190 of FIG. 1), process 400 (e.g., and therefore may be analogous to electron source 390 of FIG. 3), process 600 (e.g., and therefore may be analogous to electron source 590 of FIG. 5), or some combination thereof. Additionally, as shown in FIG. 1, CNTs 170 may be grown from metal substrate 110 and physically separated by inhibitor 710, where inhibitor 710 is analogous to metal inhibitor 165 of FIG. 1, inhibitor 325 of FIG. 3, inhibitor 525 of FIG. 5, or some combination thereof.

Step 820 involves disposing an absorber layer on the patterned CNT sculptured substrate. For example, as shown in FIG. 7, absorber layer 720 is disposed on sculptured substrate 790 (e.g., on inhibitor 710 and the CNTs 170). The absorber layer (e.g., 720) may be applied to the patterned CNT sculptured substrate (e.g., 790) using sputtering, chemical vapor deposition (CVD), etc. Additionally, absorber layer 720 may be a thin film in one embodiment.

As shown in FIG. 8, step 830 involves disposing an acceptor layer on the absorber layer. For example, as shown in FIG. 7, acceptor layer 730 is disposed on absorber layer 720. The acceptor layer (e.g., 730) may be applied to the absorber layer (e.g., 720) using sputtering, chemical vapor deposition (CVD), etc. Additionally, acceptor layer 730 may be a thin film in one embodiment.

Accordingly, process 800 may be used to produce a solar cell (e.g., 795) using a patterned CNT sculptured substrate (e.g., 790) with a metal substrate (e.g., 110). The solar cell (e.g., 795) may be used to generate a voltage potential between the metal substrate (e.g., 110) and the acceptor layer (e.g., 730) when exposed to sunlight.

In one embodiment, the metal substrate (e.g., 110) may function as an anode while the acceptor layer (e.g., 730) may function as a cathode, where the metal substrate (e.g., 110) may release electrons to the acceptor layer (e.g., 730) when exposed to sunlight. In this manner, the patterned CNT sculptured substrate (e.g., 790) may function as an electron donor.

Alternatively, In one embodiment, the metal substrate (e.g., 110) may function as an cathode while the acceptor layer (e.g., 730) may function as a anode, where the acceptor layer (e.g., 730) may release electrons to the metal substrate (e.g., 110) when exposed to sunlight. In this manner, the patterned CNT sculptured substrate (e.g., 790) may function as an electron acceptor.

Although FIG. 7 shows solar cell 795 with components (e.g., metal substrate 110, inhibitor 710, CNTs 170, absorber layer 720 and acceptor layer 730) of a specific number, shape, size, etc., it should be appreciated that components of a different number, shape, size, etc. may be used in other embodiments. For example, solar cell 795 maybe shaped like a roof tile, roof shingle or another surface, thereby enabling solar cell 795 to be applied to a roof tile (e.g., for a home) or manufactured as a part of a roofing material (e.g., for generating solar energy for use in the home, captured and used elsewhere, etc.). And in other embodiments, solar cell 795 may be alternatively shaped and/or sized.

In the foregoing specification, embodiments of the invention have been described with reference to numerous specific details that may vary from implementation to implementation. Thus, the sole and exclusive indicator of what is, and is intended by the applicant to be, the invention is the set of claims that issue from this application, in the specific form in which such claims issue, including any subsequent correction. Hence, no limitation, element, property, feature, advantage, or attribute that is not expressly recited in a claim should limit the scope of such claim in any way. Accordingly, the specification and drawings are to be regarded in an illustrative rather than a restrictive sense.

What is claimed is:

1. A method of manufacturing an electron source, said method comprising:

applying an inhibitor to a first plurality of regions of a metal substrate, wherein said inhibitor is operable to inhibit growth of carbon nanotubes in said first plurality of regions of said metal substrate; and growing carbon nanotubes on said metal substrate in a second plurality of regions separate from said first plurality of regions; wherein said applying an inhibitor further comprises:

applying photoresist to said metal substrate;

exposing a portion of said photoresist to ultraviolet light using a photolithography process, wherein said portion of said photoresist is disposed on said second plurality of regions;

removing unexposed portions of said photoresist disposed on said first plurality of regions of said metal substrate;

applying said inhibitor to said metal substrate and said portion of said photoresist; and removing said portion of said photoresist and leaving said inhibitor disposed on said first plurality of regions of said metal substrate.

2. The method of claim 1, wherein said metal substrate comprises a material selected from the group consisting of a metal operable to grow carbon nanotubes and a metal alloy operable to grow carbon nanotubes.

3. The method of claim 1, wherein said inhibitor comprises a material selected from a group consisting of a non-metal, a polymer, and a metal operable to inhibit the growth of carbon nanotubes.

4. The method of claim 1, wherein said inhibitor comprises a polymer, and wherein said applying an inhibitor further comprises:

applying a polymer to said metal substrate;

patterning said polymer using a patterned stamp, wherein said patterned stamp comprises features corresponding to said first plurality of regions; and curing said polymer while said patterned stamp is in place.

5. The method of claim 1, wherein said applying said inhibitor further comprises applying said inhibitor using a bubble jet printing process.

6. The method of claim 1 further comprising:

disposing an absorber layer on said inhibitor and said carbon nanotubes; and disposing an acceptor layer on said absorber layer.

7. The method of claim 6, wherein said disposing said absorber layer and said acceptor layer are performed using a process selected from sputtering and chemical vapor deposition.

8. The method of claim 1 further comprising:

polishing said metal substrate prior to applying said inhibitor, said polishing generating an RMS surface roughness of less than approximately 5 nanometers.

9. The method of claim 6, further comprising exposing said acceptor layer to a light source in which a voltage potential with respect to said substrate is generated.

10. A method of creating an electron source on a metal substrate, said method comprising:

applying a photoresist to the metal substrate;

selectively exposing portions of the photoresist to a light source thereby forming exposed photoresist portions and unexposed photoresist portions;

removing the unexposed photoresist portions from the metal substrate;

applying a carbon nanotube growth inhibitor to the exposed photoresist portions and metal substrate;

removing the exposed photoresist portions from the metal substrate; and growing carbon nanotubes on portions of the metal substrate where the carbon nanotube growth inhibitor is not applied.

11. The method of claim 10, in which the metal substrate comprises a material selected from a group consisting of a metal operable to grow carbon nanotubes and a metal alloy operable to grow carbon nanotubes.

12. The method of claim 10, in which the inhibitor comprises a material selected from a group consisting of a non-metal, a polymer, and a metal operable to inhibit the growth of carbon nanotubes.

13. The method of claim 10, further comprising:

disposing an absorber layer on the carbon nanotube growth inhibitor and carbon nanotubes; and disposing an acceptor layer on said absorber layer.

14. The method of claim 13, further comprising exposing said acceptor layer to a light source in which a voltage potential with respect to said substrate is generated.

* * * * *